US007163428B2

(12) United States Patent
Sanschagrin

(10) Patent No.: US 7,163,428 B2
(45) **Date of Patent: *Jan. 16, 2007**

(54) OUTBOARD ENGINE COWLING

(75) Inventor: Stéphane Sanschagrin, Valcourt (CA)

(73) Assignee: BRP US Inc., Sturtevant, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/080,627

(22) Filed: Mar. 16, 2005

(65) Prior Publication Data

US 2005/0164573 A1 Jul. 28, 2005

Related U.S. Application Data

(63) Continuation of application No. 10/410,236, filed on Apr. 10, 2003.

(60) Provisional application No. 60/375,400, filed on Apr. 26, 2002, provisional application No. 60/371,495, filed on Apr. 11, 2002.

(51) Int. Cl.
*B63H 20/00* (2006.01)
*B63H 20/32* (2006.01)
*B63H 21/36* (2006.01)

(52) U.S. Cl. ..... 440/77; 123/195 C

(58) Field of Classification Search ..... 440/76–78, 440/900; 123/195 C, 195 P; D12/4; D15/4
See application file for complete search history.

(56) References Cited

U.S. PATENT DOCUMENTS

| | | | | |
|---|---|---|---|---|
| D101,232 | S | 9/1936 | Linthwaite | |
| 2,464,734 | A | 3/1949 | Tulowiecki | |
| 2,780,331 | A | 2/1957 | Armstrong | |
| D182,354 | S * | 3/1958 | Brennan | D15/4 |
| 2,887,563 | A | 5/1959 | Kikhafer | |
| D188,922 | S * | 9/1960 | Bourke | D15/4 |
| 2,995,650 | A | 8/1961 | Kiekhaefer | |
| 3,018,754 | A * | 1/1962 | Snyder et al. | 440/63 |
| 3,080,581 | A | 3/1963 | Smihal | |
| 3,584,463 | A * | 6/1971 | Hansen | 137/363 |
| 3,737,651 | A | 6/1973 | Shute | |
| 3,870,875 | A | 3/1975 | Altimus | |
| 4,228,983 | A * | 10/1980 | Bowman, Jr. | 248/553 |

(Continued)

FOREIGN PATENT DOCUMENTS

JP 58199295 A 11/1983

(Continued)

OTHER PUBLICATIONS

Patent Abstracts of Japan, vol. 0175, No. 69 (M-1496), Oct. 15, 1993.

(Continued)

*Primary Examiner*—Ajay Vasudeva
(74) *Attorney, Agent, or Firm*—Osler, Hoskin & Harcourt LLP

(57) ABSTRACT

A cowling for an outboard marine engine includes an upper motor cover and a lower motor cover that cover an engine, and a gear case that houses a drive mechanism. The upper motor cover detachably mates with the lower motor cover along corresponding edges. At least one mating edge on one side of each cover is generally V-shaped for assisting with cover alignment during assembly.

20 Claims, 7 Drawing Sheets

U.S. PATENT DOCUMENTS 4,348,194 A * 9/1982 Walsh ..... 440/77
4,493,661 A 1/1985 Iwai
4,571,193 A 2/1986 Takada et al.
4,661,076 A 4/1987 Iwai
4,872,859 A * 10/1989 Griffiths et al. ..... 440/53
4,927,194 A 5/1990 Wagner
4,930,790 A 6/1990 Sheridan
4,971,587 A 11/1990 Uchida et al.
4,993,978 A 2/1991 Johannes
5,025,763 A 6/1991 Watanabe
5,064,393 A 11/1991 Inoue
5,088,439 A 2/1992 Anderson
5,096,208 A 3/1992 Westberg
5,120,248 A 6/1992 Daleiden et al.
5,135,239 A 8/1992 Kato
5,137,481 A 8/1992 Wengler
5,181,870 A 1/1993 Arai et al.
5,195,483 A 3/1993 Ishida
5,263,684 A 11/1993 Hiroshi
5,338,236 A 8/1994 Dunham et al.
5,340,343 A * 8/1994 Kawamukai et al. ..... 440/77
5,391,099 A 2/1995 Allain
5,445,547 A 8/1995 Akiyoshi
5,577,697 A 11/1996 Accordino
5,613,886 A 3/1997 Cribbs
5,803,777 A 9/1998 Noriyoshi
D412,911 S 8/1999 Lekura
5,951,341 A * 9/1999 Rinzaki et al. ..... 440/77
5,980,073 A 11/1999 Whipple
D418,519 S 1/2000 Lekura
6,017,254 A 1/2000 Kazuhiko et al.
D421,444 S 3/2000 Hatch et al.
D422,599 S 4/2000 Lekura
6,080,025 A 6/2000 Isogawa et al.
D428,616 S 7/2000 Lekura
6,132,273 A 10/2000 Manabu et al.
6,189,754 B1 2/2001 Cutajar et al.
6,200,009 B1 3/2001 Schulte
6,217,200 B1 4/2001 Huffman
D457,166 S 5/2002 Burmeister et al.
6,386,740 B1 5/2002 Grissom
D458,273 S 6/2002 Burmeister et al.
6,425,787 B1 7/2002 Hersom
D461,575 S 8/2002 Whipple
D463,448 S 9/2002 Osumi et al.
6,524,148 B1 2/2003 Yoshigasaki et al.
D474,784 S 5/2003 Sanschagrin et al.
6,579,135 B1 6/2003 Nemoto et al.
6,634,774 B1 10/2003 Redding
6,663,450 B1 12/2003 Walczak et al.
6,669,517 B1 * 12/2003 Alby et al. ..... 440/77
6,682,379 B1 1/2004 Walczak et al.

FOREIGN PATENT DOCUMENTS

JP 59149894 A 8/1984
JP 61261193 A 11/1986
JP 02147496 A 6/1990
JP 02193797 A 7/1990
JP 02212295 A 8/1990
JP 04271993 A * 9/1992
JP 04274992 A 9/1992
JP 05131984 A 5/1993
JP 05162692 6/1993
JP 07040891 A 2/1995
JP 09156592 A 6/1997
JP 09240588 A * 9/1997
JP 09280129 A * 10/1997
JP 10175595 A 6/1998

OTHER PUBLICATIONS

AOMCI Members Photo Gallery / http://www.aomci.org/gallery/index.htm/ pp. 1 to 2.
eBay Motors: Sears 7.5 HP Outboard Motor (item 4615997107) pp. 1 to 2.
eBay Motors: Ted Williams 7.5 HP Outboard Motor Runs Good No Reserve (item 4616745111 . . . ) pp. 1 to 3.
http://www.evinrude.com/evinrude/web/jsp/mainPage.jsp?Parame-N.US.200001.0, Copyright 2001.
http://www.evinrude.com/evinrude/web/jsp/mainPage.jsp?Parame-N.US.200002.0, Copyright 2001.
http://www.evinrude.com/evinrude/web/jsp/mainPage.jsp?Parame-N.US.200003.0, Copyright 2001.
http://www.evinrude.com/evinrude/web/jsp/mainPage.jsp?Parame-N.US.200004.0, Copyright 2001.
http://www.johnson.com/johnson/web/jsp/mainPage.jsp?Parame-N.US.200008.0, Copyright 2001.
http://www.johnson.com/johnson/web/jsp/mainPage.jsp?Parame-N.US.200009.0, Copyright 2001.
http://www.johnson.com/johnson/web/jsp/mainPage.jsp?Parame-N.US.200001.0, Copyright 2001.
http://www.johnson.com/johnson/web/jsp/mainPage.jsp?Parame-N.US.200002.0, Copyright 2001.
http://www.johnson.com/johnson/web/jsp/mainPage.jsp?Parame-N.US.200004.0, Copyright 2001.
http://www.johnson.com/johnson/web/jsp/mainPage.jsp?Parame-N.US.200005.0, Copyright 2001.
http://www.johnson.com/johnson/web/jsp/mainPage.jsp?Parame-N. US.200005.0, Copyright 2001.
http://www.honda-marine.com/bf225.htm, Copyright 2000.
http://www.honda-marine.com/bf130.htm, Copyright 2000.
http://www.honda-marine.com/bf90.htm, Copyright 2000.
http://www.honda-marine.com/bf50.htm, Copyright 2000.
http://www.honda-marine.com/bf40.htm, Copyright 2000.
http://www.honda-marine.com/bf30.htm, Copyright 2000.
http://www.honda-marine.com/bf15.htm, Copyright 2000.
http://www.honda-marine.com/bf9.9.htm, Copyright 2000.
http://www.honda-marine.com/bf8.htm, Copyright 2000.
http://www.honda-marine.com/bf5.htm, Copyright 2000.
http://www.honda-marine.com/bf2.htm, Copyright 2000.
http://www.mercurymarine.com/cgi-bin/mercprod/MercuryHome/Templates/DotComTemplate.jsp?BV_UseBVCookie-no&ParentID-null&page_id-643&ProdID-23306&Area-Saltwater%20OptiMax&BV_SessionID-@@@@0551736409.1035904509@@@@&BV_EngineID-hadcfhklffejbedcfececjf.0, Copyright2002.
http://www.mercurymarine.com/cgi-bin/mercprod/MercuryHome/Templates/DotComTemplate.jsp?BV_UseBVCookie-no&ParentID-null&page_id-643&ProdID-23306&Area-Saltwater%20OptiMax&CurSpecPos-2&BV_SessionID-@@@@0551736409.1035904509@@@@&BV_EngineID-hadcfhklffejbe dcfececjf.0, Copyright2002.
http://www.mercurymarine.com/cgi-bin/mercprod/MercuryHome/Templates/DotComTemplate.jsp?BV_UseBVCookie-no&ParentID-null&page_id-643&ProdID-23306&Area-Saltwater%20OptiMax&CurSpecPos-3&BV_SessionID-@@@@0551736409.1035904509@@@@&BV_EngineID-hadcfhklffejbe dcfececif.0, Copyright2002.
http://www.mercurymarine.com/cgi-bin/mercprod/MercuryHome/Templates/DotComTemplate.jsp?BV_UseBVCookie-no&ParentID-null&page_id-643&PeosIS-23328&Area-Saltwater%20Carb&BV_SessionID-@@@@0551736409.1035904509@@@@&BV_EngineID-hadcfhklffejbedcfececjf.0, Copyright2002.
http://www.mercurymarine.com/cgi-bin/mercprod/MercuryHome/Templates/DotComTemplate.jsp?BV_UseBVCookie-no&ParentID-null&page_id-643&ProdID-23328&Area-Saltwater%20Carb&CurSpecPos-2&BV_SessionID-@@@@0551736409.1035904509@@@@&BV_EngineID-hadcfhklffejbedcf ececjf.0, Copyright2002.

http://www.mercurymarine.com/cgi-bin/mercprod/MercuryHome/Templates/DotComTemplate.jsp?BV_UseBVCookie-no&ParentID-null&page_id-643&ProdID-23571&Area-Portable%20FourStroke&CurSpecPos-1&BV_SessionID-@@@@0551736409.1035904509@@@@&BV_EngineID-hadcfhklffejbedcfececjf.0, Copyright2002.

http://www.mercurymarine.com/cgi-bin/mercprod/MercuryHome/Templates/DotComTemplate.jsp?BV_UseBVCookie-no&ParentID-null&page_id-643&ProdID-23571&Area-Portable%20FourStroke&CurSpecPos-3&BV_SessionID-@@@@0551736409.1035904509@@@@&BV_EngineID-hadcfhklffejbedcfececjf.0, Copyright2002.

http://www.mercurymarine.com/cgi-bin/mercprod/MercuryHome/Templates/DotComTemplate.jsp?Bv_UseBVCookie-no&ParentID-null&page_id-643&OridUD-23571&Area-Portable%20FourStroke&BV_SessionID-@@@@0551736409@@@@&BV_EngineID-hadcfhklffe jbedcfececjf.0, Copyright2002.

http://www.mercurymarine.com/cgi-bin/mercprod/MercuryHome/Templates/DotComTemplate.jsp?BV_UseBVCookie-no&ParentID-null&page_id-643&ProdID-23570&Area-Big%20Foot% 20FourStroke&BV_SessionID-@@@@0551736409.1035904509@@@@&BV_EngineID-hadcfhklffejbedcfececjf.o, Copyright2002.

http://www.mercurymarine.com/cgi-bin/mercprod/MercuryHome/Templates/DotComTemplate.jsp?BV_UseBVCookie-no&ParentID-null&page_id-643&ProdID-23570&Area-Big%20Foot% 20FourStroke&CurSpecPos-1&VB_SessionID-@@@@0551736409.1035904509@@@@&BV_EngineID-hadcfhklffejbedcfecedjf.0, Copyright2002.

http://www.mercurymarine.com/cgi-bin/mercprod/MercuryHome/Templates/DotComTemplate.jsp?BV_UseBVCookie-no&ParentID-null&page_id-643&ProdID-23570&Area-Big%20Foot%20FourStroke&CurSpecPos-3&BV_SessionID-@@@@0551736409@@@@&BV_EngineID-hadcfhklffejbedcfececjf.0, Copyright2002.

http://www.mercurymarine.com/cgi-bin/mercprod/MercuryHome/Templates/DotComTemplate.jsp?BV_UseBVCookie-no&ParentID-null&page_id-643&ProdID-23570&Area-Big%20Foot%20FourStroke&CurSpecPos-4 &BV_SessionID@@@@0551736409@@@&BV_EngineID-hadcfhklffe bedcfececjf.0, Copyright2002.

http://www.mercurymarine.com/cgi-bin/mercprod/MercuryHome/Templates/DotComTemplate.jsp?BV_UseBVCookie-no&ParentID-null&page_id-218&page_643&ProdID-23194&Area-V-6%20EFI&CurSpecPos-4&BV_SessionID-@@@@0551736409.1035904509@@@@&BV_EngineID-hadcfhklffejbedcfecedjf.0, Copyright2002.

http://www.mercurymarine.com/cgi-bin/mercprod/MercuryHome/Templates/DotComTemplate.jsp?BV_UseBVCookie-no&ParentID-null&page_id-643&ProdID-23210&Area-30%20-%20125%20hp&CurSpecPos-4&BV_SessionID-@@@@0551736409.1035904509@@@@&BV_EngineID-hadcfhklffejbedcfececjf.0, Copyright2002.

http://www.mercurymarine.com/cgi-bin/mercprod/MercuryHome/Templates/DotComTemplate.jsp?BV_UseBVCookie-no&ParentID218&page_id-643&ProdID-23246&Area-6%20-%2025%20hp&BV_SessionID-@@@@0551736409.1035904509@@@@&BV_EngineID-hadcfhklffejbedcfececjf.0, Copyright2002.

http://www.mercurymarine.com/cgi-bin/mercprod/MercuryHome/Templates/DotComTemplate.jsp?BV_UseBVCookie-no&ParentID-null&page_id-643&ProdID-23246&Area-6%20-%2025%20hp&CurSpecPos-4&BV_SessionID-@@@@0551736409.1035904509@@@@&BV_EngineID-hadcfhklffejbedcfececjf.0, Copyright2002.

http://www.mercurymarine.com/cgi-bin/mercprod/MercuryHome/Templates/DotComTemplate.jsp?BV_ UseBVCookie-no&ParentID-218&page_id-643&ProdID-23259&Area-2.5%20-%205%20hp&BV_SessionID-@@@@0551736409.1035904509@@@@&BV_EngineID-hadcfhklffejbedcfececjf.0, Copyright2002.

http://www.mercurymarine.com/cgi-bin/mercprod/MercuryHome/Templates/DotComTemplate.jsp? BV_UseBVCookie-no&ParentID-null&page_id-643&ProdID-23259&Area-2.5%20-%205% 20hp&CurSpecPos-2&BV_SessionID-@@@@0551736409.@@@&BV_EngineID-hadcfhklffejbedcfececif.0, Copyright2002.

http://www.mercurymarine.com/cgi-bin/mercprod/MercuryHome/Templates/DotComTemplate.jsp? BV_UseBVCookie-no&ParentID-null&page_id-643&ProdID-23569&Area-Mid-Range% 20FourStroke&BV_SessionID-@@@@0551736409.1035904509@@@@&BV_EngineID-hadcfhklffejbedcfececjf.0, Copyright2002.

http://www.mercurymarine.com/cgi-bin/mercprod/MercuryHome/TemplatesDotComTemplate.jsp? BV_UseBVCookie-no&ParentID-null&page_id-643&ProdID-23569&Area-Mid-Range% 20FourStroke&CurSpecPos-6&BV_SessionID-@@@@0551736409.103590409@@@@&BV_EngineID-hadcfhklffejbedcfececjf.0, Copyright2002.

http://www.mercurymarine.com/cgi-bin/mercprod/MercuryHome/Templates/DotComTemplate.jsp? BV_UseBVCookie-no&ParentID-218&page_id-643&ProdID-23259&Area-2.5%20-%205% 20hp&BV_SessionID-@@@@0551736409.1035904509@@@@&BV_EngineID-hadcfhklffejbedcfececjf.0, Copyright2002.

http://www.mercurymarine.com/cgi-bin/mercprod/MercuryHome/Templates/DotComTemplate.jsp? BV_UseBVCookie-no&ParentID-null&page_id-643&PProdID-23259&Area-2.5%20-%205% 20hp&CurSpecPos-2&BV_SessionID-@@@@0551736409.1035904509@@@@&BV_EngineID-hadcfhklffejbedcfececjf.0, Copyright2002.

http://www.mercurymarine.com/cgi-bin/mercprod/MercuryHome/Templates/DotComTemplate.jsp? BV_UseBVCookie-no&ParentID-null&page_id-643&ProdID-23685&Area-Performance% 20Outboards&CurSpecPos-4&BV_SessionID-@@@@0551736409.1035904509@@@@&BV_EngineID-hadcfhklffejbedcfececjf.0, Copyright2002.

http://www.mercurymarine.com/cgi-bin/mercprod/MercuryHome/Templates/DotComTemplate.jsp? BV_UseBVCookie-no&ParentID-202&page_id-643&ProdID-23705&Area-Race% 20Outboards&BV_SessionID-@@@@0551736409.1035904509@@@@&BV_EngineID-hadcfhklffejbedcfececjf.0, Copyright2002.

http://www.mercurymarine.com/cgi-bin/mercprod/MercuryHome/Templates/DotComTemplate.jsp? BV_UseBVCookie-no&ParentID-null&page_id-643&ProdID-23705&Area-Race% 20Outboards&CurSpecPos-1&BV_SessionID-@@@@0551736409.1035904509@@@@&BV_EngineID-hadcfhklffejbedcfececjf.0, Copyright2002.

http://www.yamaha-motor.com/products/subcatinfo.asp?lid-5&lc-otb&cid-19&scid-1&year-2003&cat-Four+Stroke+Series&scat-High+Power, Copyright 1996-2002.

http://www.yamaha-motor.com/products/subcatinfo.asp? lid-5&lc-otb&cid-19&scid-2&year-2003&cat-Four+Stroke+Series&scat-Midrange, Copyright 1996-2002.

http://www.yamaha-motor.com/products/subcatinfo.asp?lid-5&lc-otb&cid-19&scid-3&year-2003&cat-Four+Stroke+Series&scat-Jet+Drive, Copyright 1996-2002.

http://www.yamaha-motor.com/products/subcatinfo.asp?lid-5&lc-otb&cid-19&scid-4&year-2003&cat-Four+Stroke+Series&scat-High+Trust, Copyright 1996-2002.

http://www.yamaha-motor.com/products/subcatinfo.asp?lid-5&lc-otb&cid-19&scid-5&year-2003&cat-Four+Stroke+Series&scat-Portable, Copyright 1996-2002.

http://www.yamaha-motor.com/products/subcatinfo.asp?lid-5&lc-otb&cid-11&year-2003&cat-HDPI+Series, Copyright 1996-2002.

http://www.yamaha-motor.com/products/subcatinfo.asp?lid-5&lc-otb&cid-7&year-2003&cat-V+MAX+Series&scat-HDPI, Copyright 1996-2002.

http://www.yamaha-motor.com/products/subcatinfo.asp?lid-5&lc-otb&cid-18&scid-6&year-2003&cat-V+MAX+Series&scat-3%2EIL+Big+Block, Copyright 1996-2002.

http://www.yamaha-motor.com/products/subcatinfo.asp?lid-5&lc-otb&cid-8&year-2003&cat-V+MAX+Series&scat-2%2E6L+OX66+%2F+Carb, Copyright 1996-2002.
http://www.yamaha-motor.com/products.subcatinfo.asp?lid-5&lc-otb&cid-20&scid-12&year-2003&cat-Two+Stroke+Series&scat-OX66+Saltwater+SeriesII, Copyright 1996-2002.
http://www.yamaha-motor.com/products/subcatinfo.asp?lid-5&lc-otb&cid-9&year-2003&cat-Two+Stroke+Series&scat-High+Power, Copyright 1996-2002.
http://www.yamaha-motor.com/products/subcatinfo.asp?lid-5&lc-oth&cid-20?scid-10&year-2003&cat-Two+Stroke+Series&scat-Midrange, Copyright 1996-2002.
http:/3www.yamaha-motor.com/products/subcatinfo.asp?lid-5&lc-otb&cid-20&scid-11&year-2003&cat-Two+Stroke+Series&scat-Portable, Copyright 1996-2002.
http://www.suzukimarine.com/4strokes/iindex.html, Copyright 1996-2002.
http://www.suzukimarine.com/2strokes/index.html, Copyright 1996-2002.
http://www.suzukimarine.com/sr00/info/frshore.htm Copyright 1996-2000.
http://www.suzukmarine.com/sr00/info/mid/htm, Copyright 1996-2000.
http://www.suzukimarine.com/sr00/info/mid4s.htm Copyright 1996-2000.
http://www.suzukimarine.com/sr00/info/port/htm Copyright 1996-2000.
http://www.suzukimarine.com/sr00/info/frperf.htm, Copyright 1996-2000.
http://www.suzukimarine.com/sr97/ccormp.htm, Copyright 1996/97.
http://www.suzukimarine.com/sr97/port.htm, copyright 1996/97.
http://www.suzukimarine.com/sr97/fstrok.htm, Copyright 1996/97.
Patent Abstracts of Japan, vol. 0175, No. 69 (M-1496), Oct. 15, 1993.

* cited by examiner

OUTBOARD ENGINE COWLING

This application claims priority from U.S. provisional application Nos. 60/371,495 filed Apr. 11, 2002 and 60/375,400 filed Apr. 26, 2002, and is a continuation of U.S. application Ser. No. 10/410,236 filed Apr. 10, 2003, all of which are incorporated herein by reference.

BACKGROUND OF THE INVENTION

1. Field of the Invention

This invention relates to outboard marine engines. In particular, this invention relates to the cover or cowling for such an engine.

2. Description of Related Art

Outboard marine engines are generally self contained engines that have a propulsion device, such as a propeller, a turbine, or a jet propulsion unit, that is powered by an internal combustion engine or electric motor, for example. Outboard engines are generally mounted on small to midsize watercraft to provide driving power to the watercraft. The degree of sophistication of such engines varies widely from basic pull start engines to high-end electronically controlled engines, which can include an electric starting mechanism.

Outboard engines typically have three main sections: the top portion; the middle portion; and, the lower portion.

The top portion, known as the upper motor cover, houses at least a top portion of the engine. The upper motor cover may be made from a single piece of material or it may have a separate top known as the top cap. The top cap can have an opening therethrough to accommodate a pull rope to be used to start the engine.

The upper motor cover usually has an opening that functions as the air intake for the engine. This intake opening must be configured to prevent water from entering into the engine. To prevent entry of water, a tortuous conduit is generally provided in the upper motor cover to define an indirect path between the opening and the engine.

The middle portion is known as the lower motor cover. This portion houses the bottom of the engine, the exhaust housing, and the vertically oriented driveshaft. This portion also functions as the exhaust conduit. Exhaust gases are channeled from the engine to the exhaust housing, where they are exhausted to the atmosphere through a gasket or directly into the water through the gear case. The lower motor cover is typically made of two halves attached to each other along a vertical plane of the motor.

The lower motor cover is attached to the upper motor cover by fitting the upper motor cover onto the top of the lower motor cover. Conventionally, the joint between the upper motor cover and the lower motor cover is horizontally oriented and forms a straight line. The upper motor cover is secured to the lower motor cover by one or more locks with a seal therebetween. The locks are usually positioned at the front and/or the back of the cowling.

The lower portion is known as the gear case and includes the propeller. The gear case houses the propeller shaft and the transmission. The transmission consists of two bevel gears facing each other on the propeller shaft and a third bevel gear disposed between the first two bevel gears at the end of the driveshaft. The third bevel gear has an axis perpendicular to the propeller shaft. A mechanism is used to selectively engage one or the other of the bevel gears on the propeller shaft with the bevel gear on the driveshaft to control the direction of rotation of the propeller.

Prior art outboard engine cowlings are difficult to close when the engine is mounted on a watercraft. Since the joint is straight and horizontal, it is hard for an operator standing in a watercraft, especially when the watercraft is floating in a body of water, to align the upper motor cover with the lower motor cover to lock them together. Therefore, there is a need for an outboard engine with an upper motor cover that is easily closed and locked to the lower motor cover.

Prior art outboard engine cowlings are also difficult to lock once they are closed. Locks located at the back of the cowling are hard to reach from inside the watercraft, and locks located at the front of the cowling are hard to reach from behind the watercraft, when the watercraft is mounted on a trailer for example. Further, traditional upper motor cover locks are configured with a hook mounted on the lower motor cover and a hook-engaging member attached to the upper motor cover. If the upper motor cover is not perfectly aligned with the lower motor cover, it is difficult to latch the upper motor cover onto the lower motor cover and obtain a secure connection. Accordingly, there is a need for a cowling that provides an upper motor cover that is more easily locked onto the lower motor cover.

As there are two common versions of small to mid-size outboard engines, the electric starter type and the pull starter type, most outboard engines are available with two different upper motor covers, depending on the type of starter mechanism for that particular engine. The same is also true for large size outboard engines (more than 90 hp), although it is less common to have such engines with pull starters. However, the other parts of the engine, especially the other parts of the cowling, may be the same. This is also true for engines that are available, for example, as two-cylinder or three-cylinder versions of the same engine, which require different height covers. To accommodate this, manufacturers must have interchangeable upper motor covers for different versions of essentially the same engine, which adds to manufacturing and distribution costs. There is a need for reducing the added costs incurred by engines that are offered in different versions.

Another problem with conventional outboard engines is the lack of a light source. Large boats generally have electrical systems and accordingly have light sources. In fact, watercraft above a certain length are required by the U.S. Coast Guard to have lights. However, outboard engines are often used on small watercraft, typically small boats, especially without an on-board electrical system. Thus, these boats have no lighting, except for the U.S. Coast Guard required hand held flashlight. Some attempts have been made at incorporating lights to outboard engine cowlings, but these require that the cowling be specially molded to incorporate the light, which can be expensive and inconvenient for those who would like to retrofit their current outboard engine cowling. This poses at least an inconvenience when operating a boat in dark or dim lighting or when additional lighting would be desirable for making repairs or preparing for fishing, for example. At worst, this poses a hazard while operating the boat as there is no indication to other watercraft of the boat's presence. Thus, there is a need to provide an auxiliary light source for watercraft.

SUMMARY OF THE INVENTION

Therefore, one aspect of embodiments of this invention provides an outboard engine cowling that is easy to close by an operator in various positions.

An additional aspect of embodiments of the present invention provides a cowling that is easily and reliably locked.

A further aspect of embodiments of the present invention provides an outboard engine that is more economical to manufacture and requires fewer parts.

An additional aspect of embodiments of the present invention provides a family of engine cowlings having common parts.

Another aspect of embodiments of the present invention provides a light or reflector on an outboard engine.

An additional aspect of embodiments of the invention provides a stable support surface to safely rest the outboard engine on a support surface when dismounted from a watercraft.

In summary, this invention is directed to an outboard engine assembly comprising an engine, a vertically oriented driveshaft operatively coupled to the engine, a drive mechanism operatively coupled to the driveshaft, and a gear case that houses at least a portion of the drive mechanism, and a cowling disposed around the engine. The cowling includes an upper motor cover that surrounds at least part of the engine, and a lower motor cover that houses the remainder of the engine. The upper motor cover has a lower edge having a contoured vertical profile and the lower motor cover has an upper edge having contoured vertical profile that mates with the contoured edge of the upper motor cover. The invention is also directed solely to the cowling.

The invention is also directed to an outboard engine assembly comprising an engine, a vertically oriented driveshaft operatively coupled to the engine, a drive mechanism operatively coupled to the driveshaft, a gear case that houses at least a portion of the drive mechanism, and a cowling disposed around the engine. An electroluminescent light source is mounted on the cowling. The invention additionally covers the cowling per se with the electroluminescent light source.

Further, the invention is directed to an outboard engine assembly comprising an engine, a vertically oriented driveshaft operatively coupled to the engine, a drive mechanism operatively coupled to the engine, a gear case that houses at least a portion of the drive mechanism, and a cowling disposed around the engine. An illuminator is removably mounted on the cowling.

Also, the invention is directed to a cowling having a front, a rear, and a pair of sides. The cowling comprises an upper motor cover configured to surround at least a part of an engine, a lower motor cover that mates with the upper motor cover configured to house at least part of an engine, and a removably mounted illuminator.

According to another aspect of the invention, a method of manufacturing an engine cowling for an outboard engine that has a lower motor cover and an upper motor cover with a top cap comprises the steps of selecting an engine with a particular starter, surrounding at least a portion of the outboard engine with a lower motor cover, selecting an upper motor cover, and selecting a top cap from a plurality of top caps, each formed with an identical lower edge and being designed to accommodate the particular starter of the engine. The method further comprises securing the selected top cap to the upper motor cover by attaching the lower edge of the top cap to an upper edge of the upper motor cover, and mounting the selected upper motor cover on the lower motor cover by mating a lower edge of the upper motor cover with an upper edge of the lower motor cover.

According to another aspect of the invention, an engine cowling has an upper motor cover having an upper edge, and a top cap selected from a family of top caps, each with a different configuration. Each top cap of the family has a lower edge configured to mate with the upper edge of the upper motor cover.

Additionally, another aspect of the invention is directed to a cowling assembly comprising an upper motor cover having an exterior cowling surface, a lower motor cover having an exterior cowling surface, wherein the lower motor cover mates with the upper motor cover, and a latch handle mounted on one of the upper motor cover and the lower motor cover. A raised shoulder is positioned adjacent to the latch handle protruding outwardly from the exterior cowling surface of one of the upper motor cover and the lower motor cover. The raised shoulder has a flat, level support surface that forms a support surface for the cowling assembly.

The invention encompasses a cowling with each of the features above taken alone and in all possible combinations. The invention encompasses the combination of the cowling and its various features in combination with an outboard engine assembly.

These and other aspects of this invention will become apparent upon reading the following disclosure in accordance with the Figures.

BRIEF DESCRIPTION OF THE DRAWINGS

An understanding of the various embodiments of the invention may be gained by virtue of the following figures, of which like elements in various figures will have common reference numbers, and wherein.

DETAILED DESCRIPTION OF PREFERRED EMBODIMENTS

The invention is described with reference to a marine outboard engine for use on any type of watercraft. Of course, the outboard engine and the features of this invention can be used on any type of cowling assembly.

Figure 1:
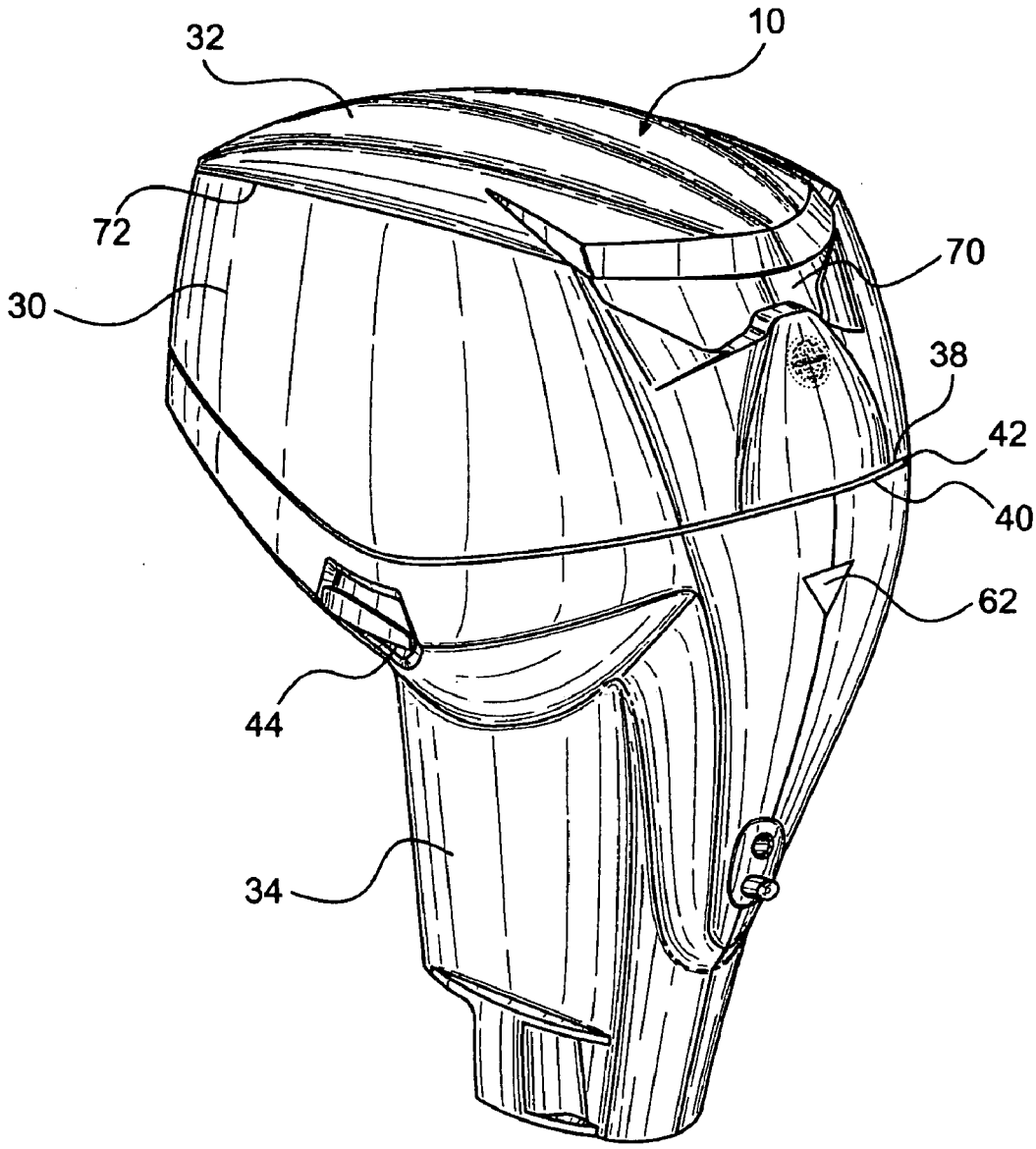
FIG. 1 is a rear perspective view of a cowling for an outboard engine in accordance with a preferred embodiment of the invention.
Figure 2:
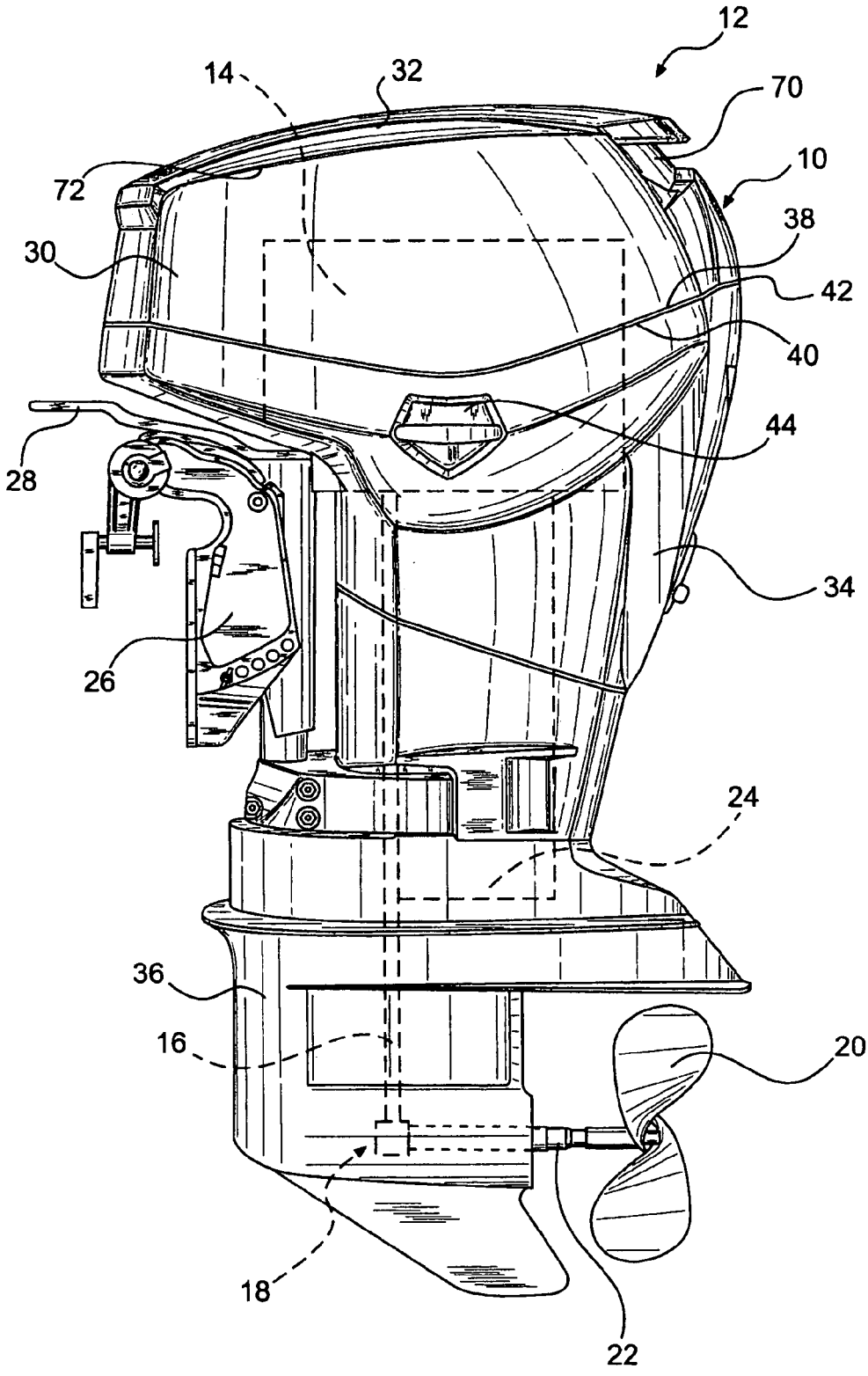
FIG. 2 is a side view of the cowling of FIG. 1 in combination with an outboard engine.

Referring to the Figures, FIG. 1 is a back perspective view of primary components of the cowling assembly 10 in accordance with the invention, while FIG. 2 is a side view of the cowling assembly 10 in combination with an outboard engine assembly 12.

The general construction of the outboard engine assembly 12 includes cowling assembly 10 that surrounds and protects an engine 14, shown schematically. Engine 14 can be a conventional internal combustion engine, such as a two-cylinder or three-cylinder engine. Engine 14 could also be an electric motor. The type of engine 14 is not critical to the invention and may take any conventional form.

The engine 14 is coupled to a vertically oriented drive-shaft 16 that is coupled to a drive mechanism 18, which typically includes a transmission and a propelling device, such as a propeller 20 mounted on a shaft 22. The drive mechanism 18 could also be a jet. propulsion device, turbine or other know propelling mechanism. Other known components of an engine assembly would be included within the cowling, such as an exhaust manifold 24. As these components would be readily recognized by one of ordinary skill in the art, further explanation is not necessary.

A mounting support 26 is connected to through the cowling assembly 10 to components within the cowling assembly 10 for mounting the outboard engine to a watercraft or other support. The mounting support 26 can take various forms, the details of which are conventionally known. The outboard engine assembly does not require the mounting support 26 to operate.

A steering mechanism 28, such as a tiller, or other control systems, such trim control, may be provided to allow the driving mechanism to be turned to facilitate directional control of the watercraft or adjusted to affect the orientation of the engine.

The cowling assembly 10 includes several primary components, including an upper motor cover 30 with a replaceable top cap 32, and a lower motor cover 34. A lowermost portion, commonly called the gear case 36, is attached to the exhaust housing (not shown in FIG. 1) which is surrounded by the lower motor cover 34. The upper motor cover 30 preferably encloses the top portion of the engine 14. The lower motor cover 34 surrounds the remainder of the engine 14 and can include the exhaust manifold 24. The gear case 36 encloses the transmission and supports the drive mechanism 18, in a known manner. The propeller shaft 22 extends from the gear case 36 and supports the propeller 20.

The upper motor cover 32 and the lower motor cover 34 are made of sheet material, preferably plastic, but could also be metal, composite or the like. The sheet material is preferably weather resistant, moisture proof, and can withstand impacts. Suitable plastics include ABS (acrilonitrile-butadiene-styrene) or Zeloy, which is manufactured by DuPont™. The lower motor cover 34 or other components of the cowling assembly 10 can be formed as a single piece or as several pieces. For example, the lower motor cover 34 can be formed as two lateral pieces that mate along a vertical joint. The lower motor cover, which is also made of sheet material, is preferably made of composite, but can also be plastic or metal. One suitable composite is fiberglass.

Figure 4:
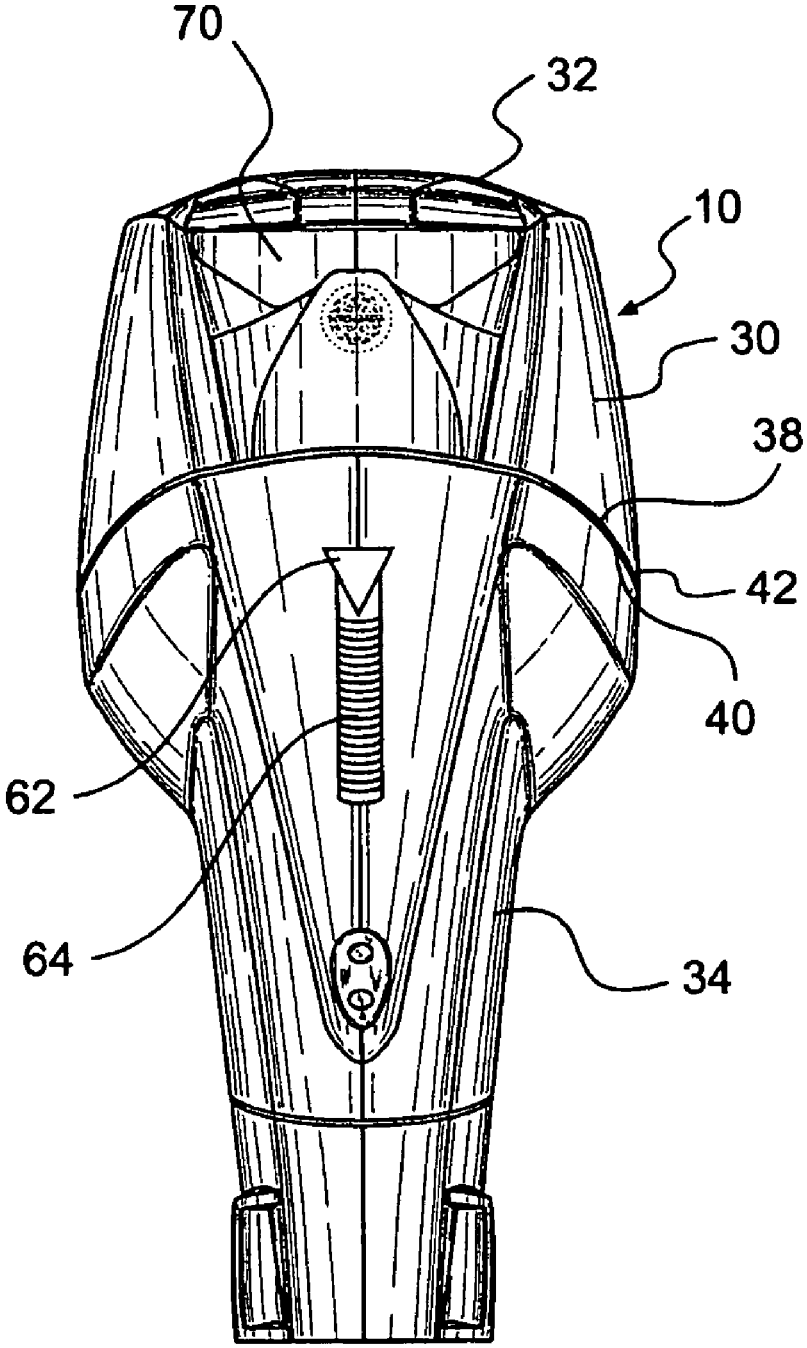
FIG. 4 is a rear view of the cowling of FIG. 1 with an alternate lamp configuration.
Figure 5:
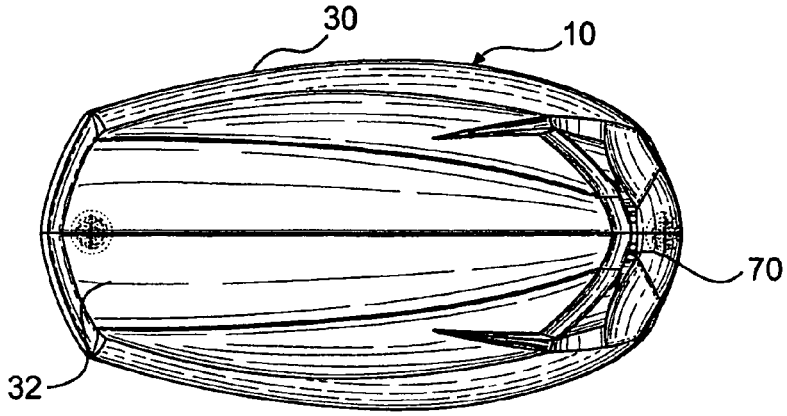
FIG. 5 is a top view of the cowling of FIG. 1.
Figure 6:
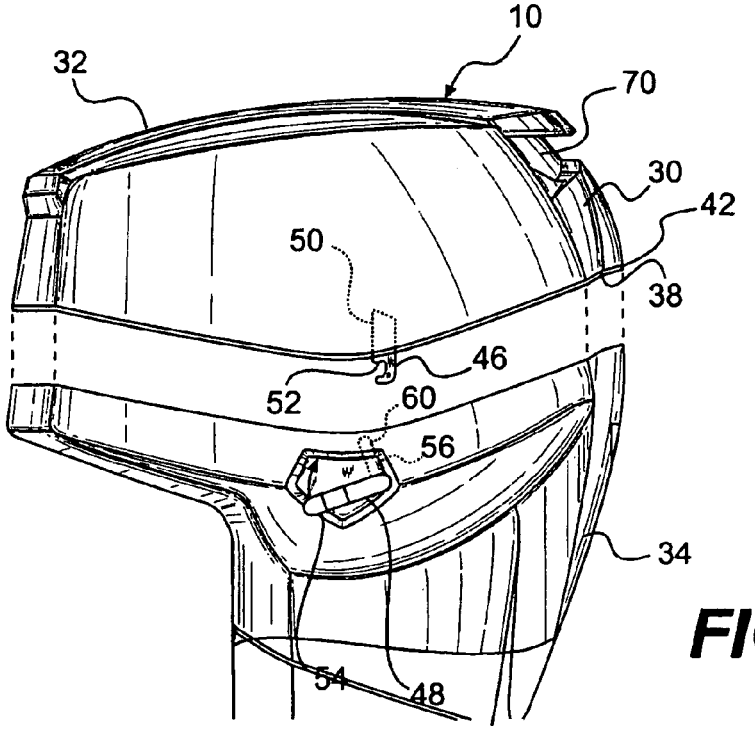
FIG. 6 is a partial exploded side view of an embodiment of the cowling in accordance invention showing the locking mechanism.

The upper motor cover 30 has a lower edge 38 that has a contoured vertical profile, preferably with a curved side wall. The lower edge 38 when viewed from the side is generally convex and has an obtuse V-shape. The lower motor cover 34 has an upper edge 40 that has a contoured vertical profile in a complementary shape to the lower edge 38 of the upper motor cover 30. That is, the upper edge 40 when viewed from the side is curved and generally concave, and has an obtuse V-shape. The lower edge 38 and the upper edge 40 mate together in a sealing relationship when the upper motor cover 30 is attached to the lower motor cover 34. Preferably, a seal 42 is disposed between the upper motor cover 30 and the lower motor cover 34 to form a watertight connection, as seen in FIG. 4. As shown in FIG. 6, the seal 42 can be secured to the upper motor cover 30 to provide a protective surface to the lower edge 38 of the upper motor cover 30 when the upper motor cover 30 is removed from the cowling assembly 10.

The curved, complementary edges 38, 40 provide a self-aligning function when placing the upper motor cover 30 on the lower motor cover 34. In operation, when the upper motor cover 30 is placed over the lower motor cover 34, the curved edges 38, 40 will naturally line up to form an accurate mating relationship. This facilitates assembly without precise alignment by an operator. This self aligning function is especially convenient when attempting to place the upper motor cover 30 on the lower motor cover 34 when the outboard engine assembly 12 is mounted on a watercraft that is afloat.

Such contoured edges, which provide the self-aligning function, can be provided on each edge or on other edges alone or in combination. Additionally, a contoured edge means that the edge can be configured as any type of curved line, such as a S-shaped line; a pattern of straight lines, such as a wedge; or a combination of the two types of lines, any of which can be used to achieve a similar result.

Figure 7:
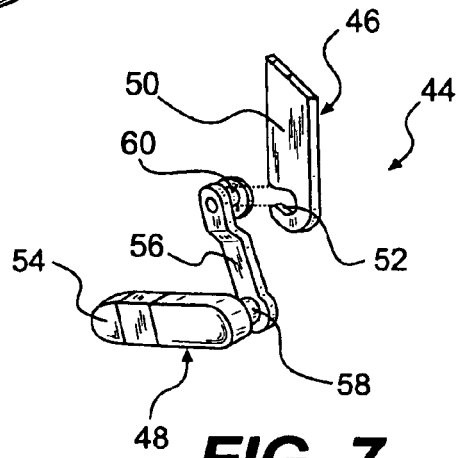
FIG. 7 is an enlarged exploded perspective view of the locking mechanism in accordance with the invention.

A locking mechanism 44 is provided on at least one of the sides of the cowling assembly 10. Preferably, a locking mechanism 44 is provided on each side of the cowling assembly 10. The locking mechanism 44 is shown in detail in FIGS. 6 and 7. The locking mechanism 44 is formed of a first part, which is a hook 46 and a second part, which is a movable latch 48. Preferably, the hook 46 is formed as a tab 50 with a groove 52 formed in one end. The hook 46 is secured to the upper motor cover 30 by any conventional means such as by bonding, welding or a fastener. The latch 48 is formed as a handle 54 attached to a lever 56 at a pivot bar 58. The end of the lever 56 includes a locking rod 60 with an enlarged head. The locking rod 60 releasably engages with the groove 52.

In operation, when the upper motor cover 30 is positioned on the lower motor cover 34, the handle 54 is pivoted about pivot bar 58 to move lever 56 so as to engage the locking rod 60 in the groove 52 of the hook 46. To unlock the upper motor cover 30, the handle 54 is pivoted downwardly to move the locking rod 60 out of the groove 52 and disengage the hook 46. By this preferred positioning and ergonomic design, with the pivot 58 positioned toward the rear of the cowling assembly 10 and the locking mechanism 44 on each side, an operator can easily access the lock from any position and operate with the mechanism comfortably.

Of course, the hook 46 and the latch 48 could be reversed with the hook 46 attached to the lower motor cover 34 and the latch attached to the upper motor cover 30, if so desired.

Referring back to FIG. 1, an illuminator 62 is provided on the cowling assembly 10. The illuminator 62 is shown positioned on the lower motor cover 34 but could also be positioned on the upper motor cover 30 or top cap 32. Moreover, one illuminator 62 is shown on the back of the cowling assembly 10. However, any number of illuminators 62 may be provided in various positions on the cowling assembly 10, if desired.

Figure 8:
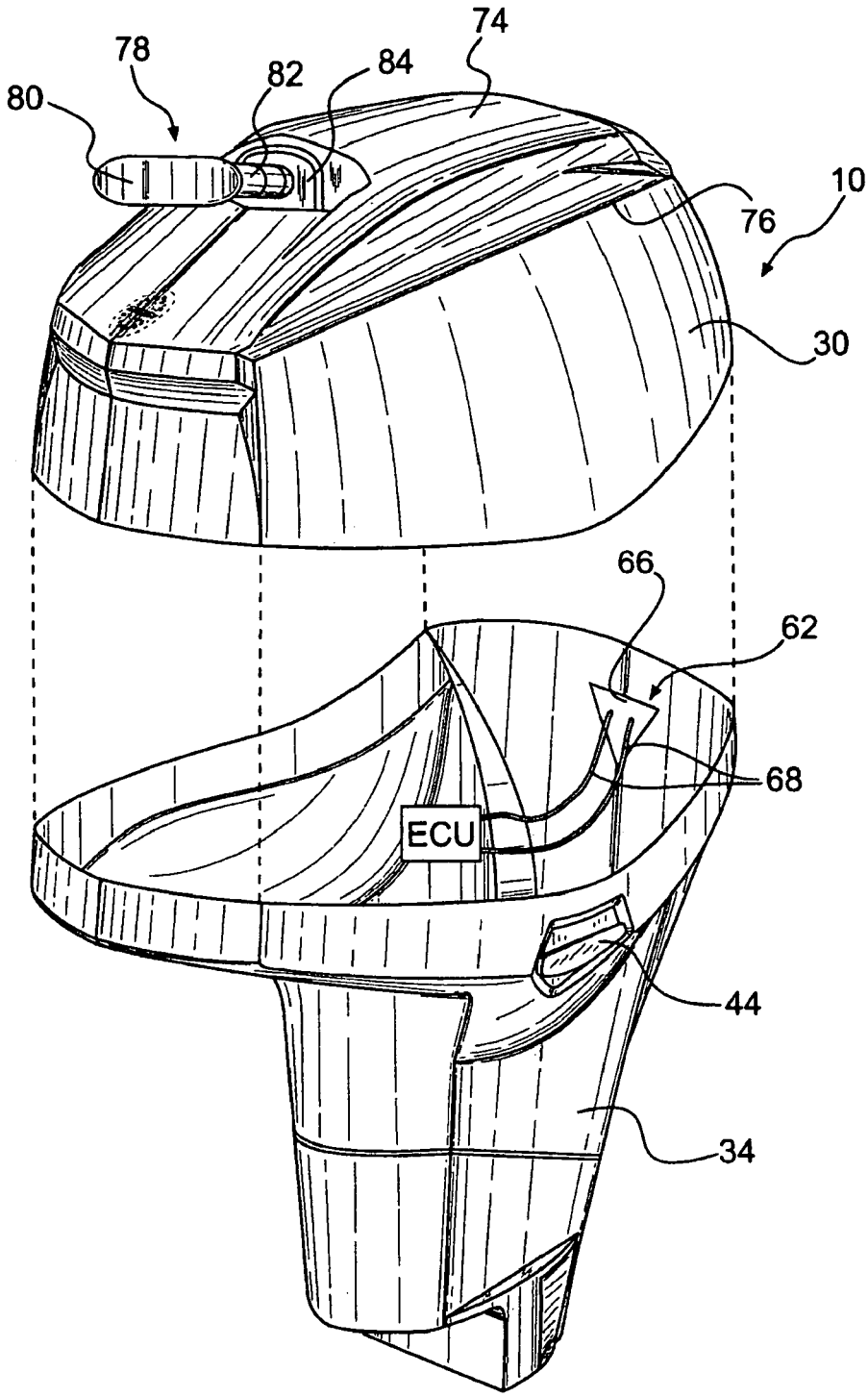
FIG. 8 is an exploded perspective view showing the interior of the lower motor cover with the details of an embodiment of the illuminator of this invention and an embodiment of the top cap of the upper motor cover in accordance with another embodiment of the invention.

The illuminator 62 may be a simple reflector or a light source, also called a lamp. The illuminator 62 can be retained within an opening in the cowling assembly 10, especially an opening in the lower motor cover 34 or secured to the outer surface of the cowling. The illuminator 62 can be electrically powered through the electrical system normally associated with the engine 14. As seen in FIG. 8, the illuminator 62 can be an electrically powered lamp with a pair of electrical connectors or wires 68 connected to an ECU of the engine 14. The ECU can control power to the lamp 62 using the power source of the engine 14 or a battery and can be programmed to selectively light the lamp 62, based on a light sensor for example.

Preferably, the lamp 62 is an electroluminescent light source, which can be obtained from Durel Corporation. (See, www.durel.com) this type of light source is easily seen in the dark, relatively inexpensive, can be made in any shape, and is waterproof. Additionally, electroluminescent light sources are easy to assemble as they are essentially stickers with electrical wires for connection to a power source. Therefore any cowling can be retrofitted with such an electroluminescent light source, since a person only needs to apply the sticker to the cowling and connect the wires to an electrical source. The wires could pass through holes made in the cowling or simply pass between lower and upper edges 38, 40. The lamp 62 could also be a removable, battery operated lamp that is preferably rechargeable.

Referring to FIG. 4, an illuminator 62 in the form of an electric or a battery operated flexible flashlight 64, such as Black & Decker®'s SnakeLight®, is shown retained on the upper motor cover 30. The flexible flashlight 64 can be removably clamped to the cowling assembly 10 or can be secured at one end to the cowling assembly 10. A charging receptacle can be provided so that the electrical system of the engine 14 recharges the light 64, if desired.

In this assembly, the illuminator 62 provides illumination to the outboard engine assembly 12. This is particularly beneficial for watercraft without running lights. The light 64 also provides an auxiliary light source that can be redirected or removed from the cowling assembly 10 to assist in engine repair or other tasks associated with the engine or watercraft.

Another aspect of this invention relates to the top cap 32 of the upper motor cover 30. Unlike the prior art, the upper motor cover 30 is formed with two parts, i.e. with a replaceable top cap 32, rather than as a single cover. As seen in FIG. 1, the upper motor cover 30 includes an air intake portion 70 formed as a recessed portion on the rear of the cowling assembly 10. The air intake portion 70 is configured to prevent water from entering the interior of the cowling assembly 10 and accordingly reaching the engine 14. Such configuration can include a tortuous path. The top cap 32 fits over the upper motor cover 30 in a sealing relationship and preferably defines a portion of the air intake portion 70. Alternatively, the air intake portion 70 can be wholly formed in the upper motor cover 30 or even the lower motor cover 34.

Figure 3:
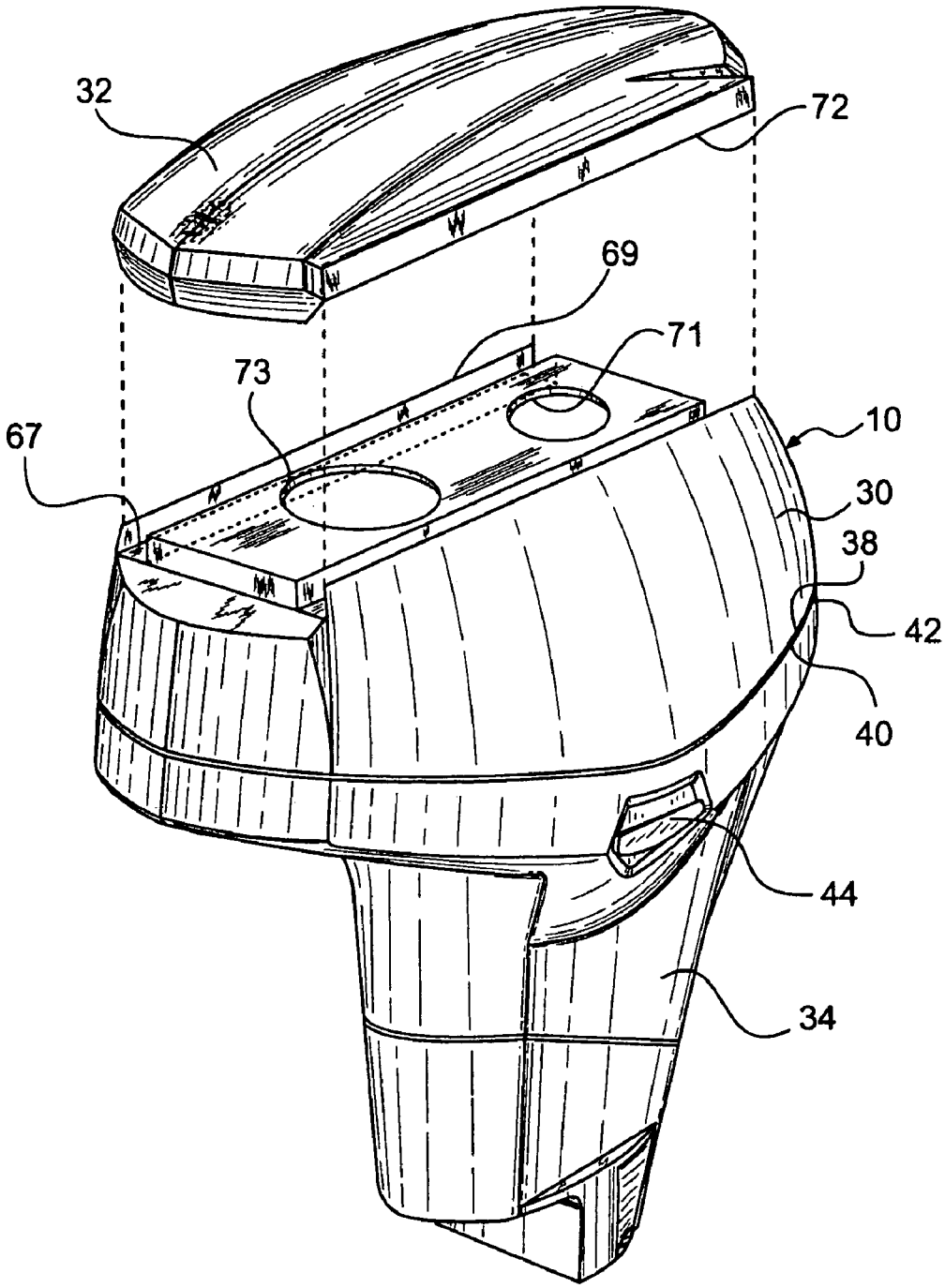
FIG. 3 is front exploded perspective view of the cowling of FIG. 1.

The top cap 32 shown in FIGS. 1–6 is designed for an outboard engine assembly 12 with an electric starting mechanism or some other type of automatic starter. With this type of engine, the top cap 32 is formed as a substantially solid plate. The top cap 32 can be formed of any rigid sheet material, preferably plastic, but could also be metal or composite. The edge 72 of the top cap 32 mates with the upper motor cover 30 in a sealing relationship. As seen in FIG. 3, the upper motor cover 30 has a pair of longitudinal channels 67 formed adjacent the upper edge 69 of the top of the upper motor cover 30. The top of the upper motor cover 30 also has several openings formed therein including an air inlet 71 and an optional starter assembly opening 73, which may be used for example to provide access to the starter handle. The top cap 32 is assembled to the upper motor cover 30 by securing the lower edge 72 in the channel 67, with an adhesive for example. Once assembled, the channels 67 provide a drainage path for any water or moisture that enters the cowling assembly 10 under the top cap 32, through the air intake portion 70 for example.

Referring now to FIG. 8, the top cap 32 may be replaced with alternative style top cap 74. The alternative top cap 74 has an edge 76 with the same configuration as the edge 72 of top cap 32 so that it may mate in the same way to upper motor cover 30. Like top cap 32, top cap 74 can define a portion of the air intake. As seen in FIG. 8, top cap 74 is designed to accommodate a pull type starter mechanism 78, which includes a handle 80 and a shaft or rope 82 that protrudes through an opening 84 in the top cap 74. Preferably, the opening 84 is designed to prevent the entry of water and contaminants into the interior of the cowling assembly 10 through a baffle system. The top cap 74 is also designed to be larger to accommodate the pull type starter 78.

The upper motor cover 30 can also be designed in several different sizes with the same edge configurations as above. Different size upper motor covers 30 can accommodate engines having different numbers of cylinders, for example.

By this configuration, the same cowling assembly 10 can be used for various different types of engines. To accommodate a manual pull starter 78, for example, the top cap 74 can be used rather than the top cap 32, which is designed for an electric starter. Other top caps can be replaced and used with variously sized upper motor covers 30 to accommodate other variations, such as engines having different numbers of cylinders. For example, an outboard engine assembly 12 having a three-cylinder engine can be provided with a larger upper motor cover than an upper motor cover designed for a two-cylinder engine. Similarly, the top cap 32 or top cap 74 can be chosen to connect to either size upper motor cover 30. By merely replacing one of the components, such as the top cap instead of the whole upper motor cover, manufacturing costs can be reduced. The various possible combinations create a family of engine cowlings for outboard engines, the cowlings having common parts. Distribution costs can also be reduced as fewer parts and smaller parts are required for different models.

Figure 9:
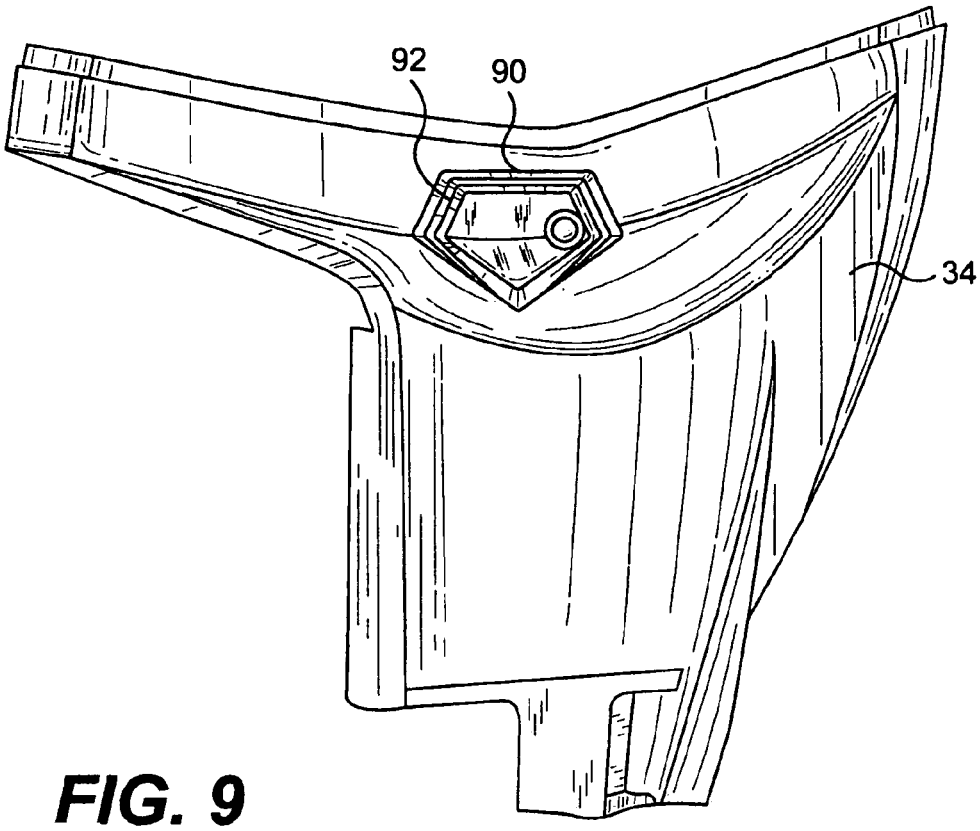
FIG. 9 is a side view of the lower motor cover with a handle shoulder.
Figure 10:
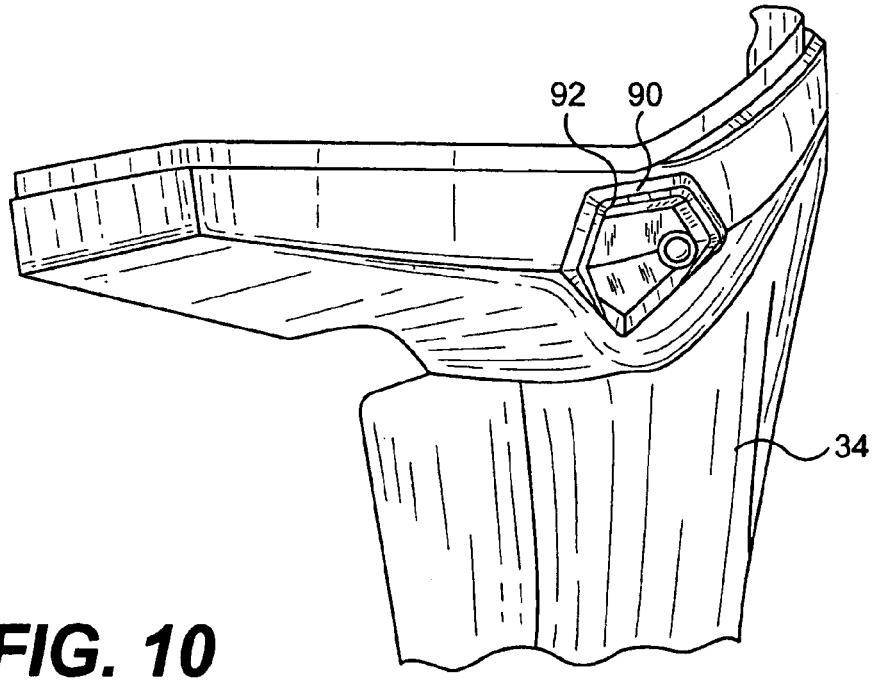
FIG. 10 is a partial side view in perspective of the lower motor cover seen in FIG. 9.

FIGS. 9 and 10 show a lower motor cover 34 with the handle removed to illustrate a modification of the cowling assembly 10 in which a raised shoulder 90 is provided at least partially around the depression 92 in which the handle (not seen in FIG. 9) is disposed. The raised shoulder 90 delineates the locking mechanism 44 (not seen in FIG. 9), which is aesthetically pleasing, and provides a level flat surface 94. This surface 94 functions as a support surface for the cowling 10 when it is removed from the watercraft. Typically, posts extend from the sides of an outboard engine to rest the engine against when placing it on the ground. However, the posts allow the engine to rock and tip over, which can damage the exterior cowling surface, the handles and possibly the engine.

In this case, when the outboard engine with the cowling 10, or just the lower motor cover 34, is placed on a surface, such as the ground, the raised shoulder 90 stably supports the assembly above the support surface. This prevents the exterior cowling surface from resting on the ground or other rough or unclean support, which could damage the exterior surface. This also protects the handles and locking mechanism from damage.

The surface 94 can extend entirely around the locking mechanism or partially around, as seen in FIGS. 9 and 10. The roughly pentagonal shape seen in FIG. 9 ensures that the cowling assembly 10 will not tip to one side as each side of the pentagon offers support. However, the shape can take any form, including circular, rectangular or triangular, in whole or part, if desired. Also, although the raised shoulder 90 is shown protruding from the exterior surface of the lower motor cover 34, the shoulder 90 could also be provided on the upper motor cover with the same effect. Further, the raised shoulder 90 can be provided merely in the vicinity of the locking mechanism, rather than surrounding it, with a similar effect.

Although the above description contains specific examples of the present invention, these should not be construed as limiting the scope of the invention but as merely providing illustrations of some of the presently preferred embodiments of this invention. Thus, the scope of the invention should be determined by the appended claims and their legal equivalents rather than by the examples given.

What is claimed is:

1. A marine outboard engine assembly comprising:
an engine;
a vertically oriented driveshaft operatively coupled to the engine;
a drive mechanism operatively coupled to the driveshaft;
a gear case housing at least a portion of the drive mechanism;
a cowling disposed around the engine;
the cowling including an upper motor cover surrounding a least an upper part of the engine, and a lower motor cover surrounding a lower part of the engine;
the upper motor cover having a top, a front side, a rear side, a left side, and a right side;
the lower motor cover having a front side, a rear side, a left side, and a right side;
at least one of the sides of the upper motor cover having an obtuse generally V-shaped lower edge when viewed from a side elevation view of the at least one of the sides, the lower edge having first and second angled portions, the first angled portion having a positive slope and the second angled portion having a negative slope when the driveshaft is disposed vertically;
a corresponding side of the lower motor cover having an obtuse generally V-shaped upper edge when viewed from a side elevation view of the corresponding side such that the upper edge mates along substantially its entire length with the lower edge, the first and second angled portions together extending substantially the entire length of the corresponding upper and lower edges; and
the at least one of the sides of the upper motor cover being detachably attached to the corresponding side of the lower motor cover and separable therefrom along the respective edges.

2. The outboard engine assembly of claim 1, wherein the at least one of the sides is one of the left side and the right side.

3. The outboard engine assembly of claim 2, wherein the at least one of the sides is both the left side and the right side.

4. The outboard engine assembly of claim 1, wherein the first angled portion is a first generally straight portion, the second angled portion is a second generally straight portion, the generally V-shaped lower edge further having an arcuate transition portion joining the first generally straight portion to the second generally straight portion, all to form the V-shape.

5. The outboard engine assembly of claim 1, wherein the lower edge is convex and the upper edge is concave.

6. The outboard engine assembly of claim 1, further comprising a seal disposed between the upper motor cover and the lower motor cover.

7. The outboard engine assembly of claim 1, further comprising at least one locking mechanism including a first part mounted on the upper motor cover and a second part mounted on the lower motor cover.

8. An outboard engine cowling of a boat comprising:
an upper motor cover configured to surround a least part of an engine having a vertical driveshaft;
a lower motor cover configured to surround at least part of the engine;
the upper motor cover having a top, a front side, a rear side, a left side, and a right side;
the lower motor cover having a front side, a rear side, a left side, and a right side;
at least one of the sides of the upper motor cover having an obtuse generally V-shaped lower edge when viewed from a side elevation view of the at least one of the sides, the lower edge having first and second angled portions, the first angled portion having a positive slope and the second angled portion having a negative slope when the driveshaft is disposed vertically;
a corresponding side of the lower motor cover having an obtuse generally V-shaped upper edge when viewed from a side elevation view of the corresponding side such that the upper edge mates along substantially its entire length with the lower edge, the first and second angled portions together extending substantially the entire length of the corresponding upper and lower edges;
the at least one of the sides of the upper motor cover being detachably attached to the corresponding side of the lower motor cover and separable therefrom along the respective edges.

9. The outboard engine cowling of claim 8, wherein the at least one side is one of the left side and the right side.

10. The outboard engine cowling of claim 9, wherein the at least one side is both the left side and the right side.

11. The outboard engine cowling of claim 8, wherein the first angled portion is a first generally straight portion, the second angled portion is a second generally straight portion, the generally V-shaped lower edge further having an arcuate transition portion joining the first generally straight portion to the second generally straight portion, all to form the V-shape.

12. The outboard engine cowling of claim 8, wherein the lower edge is convex and the upper edge is concave.

13. The outboard engine cowling of claim 8, further comprising a seal disposed between the upper motor cover and the lower motor cover.

14. The outboard engine cowling of claim 8, further comprising at least one locking mechanism including a first part mounted on the upper motor cover and a second part mounted on the lower motor cover.

15. An outboard engine assembly comprising:
an engine;
a vertically oriented driveshaft operatively coupled to the engine;
a drive mechanism operatively coupled to the driveshaft;
a gear case housing at least a portion of the drive mechanism;
a cowling disposed around the engine;
the cowling including an upper motor cover surrounding a least an upper part of the engine, and a lower motor cover surrounding a lower part of the engine;
the upper motor cover having a top, a front side, a rear side, a left side, and a right side;
the lower motor cover having a front side, a rear side, a left side, and a right side;

at least one of the sides of the upper motor cover having a first end, a second end, and a lower edge;

the lower edge having a first generally straight portion extending from the first end in a first sloping direction away from the top when viewed from a side elevation view of the at least one of the sides;

the lower edge having a second generally straight portion extending from the second end in a second sloping direction away from the top when viewed from a side elevation view of the at least one of the sides;

the first generally straight portion and the second generally straight portion converging at a vertex between the first end and the second end, the vertex representing the farthest vertical distance of the first and second generally straight portions from the top when the driveshaft is disposed vertically;

a corresponding side of the lower motor cover having an upper edge shaped to matingly engage along substantially its entire length with the lower edge; and the at least one of the sides of the upper motor cover being detachably attached to the corresponding side of the lower motor cover and separable therefrom along the respective edges.

16. The outboard engine assembly of claim 15, wherein the vertex is generally located halfway between the first end and the second end.

17. The outboard engine assembly of claim 15, wherein the vertex is generally arcuate.

18. The outboard engine cowling of claim 15, wherein the at least one of the sides is one of the left side and the right side.

19. The outboard engine cowling of claim 18, wherein the at least one of the sides is both the left side and the right side.

20. The outboard engine cowling of claim 15, further comprising a seal disposed between the upper motor cover and the lower motor cover.

* * * * *